US006550696B2

(12) United States Patent
Mansour et al.

(10) Patent No.: US 6,550,696 B2
(45) Date of Patent: Apr. 22, 2003

(54) INTEGRATED FUEL INJECTION AND MIXING SYSTEM WITH IMPINGEMENT COOLING FACE

(76) Inventors: Adel B. Mansour, 9880 Old Johnnycake Rd., Mentor, OH (US) 44060; Rex J. Harvey, 6744 Connecticut Colony Cir., Mentor, OH (US) 44060; Robert R. Tacina, 4619 Basswood Oval, Brunswick, OH (US) 44212; Peter Laing, 3871 Lampson Rd., Geneva, OH (US) 44041

( * ) Notice: Subject to any disclaimer, the term of this patent is extended or adjusted under 35 U.S.C. 154(b) by 0 days.

(21) Appl. No.: 09/794,794

(22) Filed: Feb. 27, 2001

(65) Prior Publication Data

US 2001/0050318 A1 Dec. 13, 2001

Related U.S. Application Data

(60) Provisional application No. 60/185,254, filed on Feb. 28, 2000.

(51) Int. Cl.[7] ..... B05B 7/10

(52) U.S. Cl. ..... 239/399; 239/402; 239/403; 239/404

(58) Field of Search ..... 239/399, 402, 239/403, 404, 533.2, 533.14, 584, 585.1, 585.3, 585.4, 585.5, 596; 251/129.21, 129.15

(56) References Cited

U.S. PATENT DOCUMENTS

| | | | |
|---|---|---|---|
| 1,869,809 | A | 8/1932 | Hewlett |
| 2,378,348 | A | 6/1945 | Wilmes et al. |
| 2,593,884 | A | 4/1952 | Ifield |
| 3,668,869 | A | 6/1972 | DeCorso et al. |
| 3,692,245 | A | 9/1972 | Needham et al. |
| 3,853,273 | A | 12/1974 | Bahr et al. |
| 3,886,736 | A | 6/1975 | Kawaguchi |
| 4,087,050 | A | 5/1978 | Tsuji et al. |
| 4,891,935 | A | 1/1990 | McLaurin et al. |
| 4,934,653 | A | 6/1990 | Grieb et al. |
| 4,938,019 | A | 7/1990 | Angell et al. |
| 5,115,634 | A | 5/1992 | Bretz et al. |
| 5,220,804 | A | 6/1993 | Tilton et al. |

(List continued on next page.)

FOREIGN PATENT DOCUMENTS

| | | |
|---|---|---|
| GB | 2 124 554 | 2/1994 |
| JP | 60-190593 | 9/1985 |

OTHER PUBLICATIONS

Mansour et al., Integrated Fluid Injection Air Mixing System, patent application 09/794,470 filed Feb. 27, 2001.*

*Primary Examiner*—Michael Mar
*Assistant Examiner*—Davis Hwu
(74) *Attorney, Agent, or Firm*—Christopher H. Hunter

(57) ABSTRACT

An atomizing injector includes a metering set having a swirl chamber, a spray orifice and one or more feed slots etched in a thin plate. The swirl chamber is etched in a first side of the plate and the spray orifice is etched through a second side to the center of the swirl chamber. Fuel feed slots extend non-radially to the swirl chamber. The injector also includes integral swirler structure. The swirler structure includes a cylindrical air swirler passage, also shaped by etching, through at least one other thin plate. The cylindrical air swirler passage is located in co-axial relation to the spray orifice of the plate of the fuel metering set such that fuel directed through the spray orifice passes through the air swirler passage and swirling air is imparted to the fuel such that the fuel has a swirling component of motion. At least one air feed slot is provided in fluid communication with the air swirler passage and extends in non-radial relation thereto. Air supply passages extend through the plates of the metering set and the swirler structure to feed the air feed slot in each plate of the swirler structure.

12 Claims, 15 Drawing Sheets

U.S. PATENT DOCUMENTS 5,224,333 A 7/1993 Bretz et al.
5,435,884 A 7/1995 Simmons et al.
5,449,114 A * 9/1995 Wells et al. ..... 239/5
5,622,489 A 4/1997 Monro
5,679,135 A 10/1997 Carl
5,740,967 A 4/1998 Simmons et al.
5,752,380 A 5/1998 Bosley et al.
5,860,602 A 1/1999 Tilton et al.
6,205,983 B1 * 3/2001 Egizi ..... 123/531
6,357,677 B1 * 3/2002 Ren et al. ..... 239/585.4

* cited by examiner

INTEGRATED FUEL INJECTION AND MIXING SYSTEM WITH IMPINGEMENT COOLING FACE

CROSS REFERENCE TO RELATED CASES

The present application claims priority to U.S. Provisional Application Serial No. 60/185,254; filed Feb. 28, 2000.

BACKGROUND OF THE INVENTION

1. Field of the Invention

This invention relates in general to injectors for dispensing fluids in fine sprays, and more particularly relates to fuel injectors for dispensing liquid fuel in fine sprays for ignition in gas turbine engines.

2. Description of the Prior Art

The art of producing sprays of liquid is extensive. Many injectors have a nozzle with a swirl chamber. One or more angled inlet slots direct the fluid to be sprayed into the swirl chamber. The inlet slots cause the fluid to create a vortex in the swirl chamber adjacent to a spray orifice. The fluid then exits through the spray orifice in a conical spray. Patents showing such injectors include U.S. Pat. Nos. 4,613,079 and 4,134,606.

It is believed it is much easier to design and manufacture relatively large nozzles for producing relatively large droplet sprays than to design and manufacture relatively small nozzles to produce relatively fine droplet sprays. This is especially true in the context of manufacturing the inlet slots, swirl chambers, and spray orifices in small nozzles.

In the combustion of fuels, for example, a nozzle that provides a spray of fine droplets improves the efficiency of combustion and reduces the production of undesirable air pollutants. In some applications, it is desirable to have very low Flow Numbers and Flow Numbers that vary from location to location. The "Flow Number" relates the rate of fluid flow output to the applied inlet pressure. Flow Numbers that are less than 1.0 lb/hr.psi$^{0.5}$, and even as small as 0.1 lb/hr.psi$^{0.5}$, are desirable in some applications. This corresponds to swirl chambers less than 1.905 mm (0.075 inches); and exit orifices of less than 0.3048 mm (0.012 inches) diameter.

It is believed that for many years it was only possible to manufacture many of the openings and surfaces of small nozzles to create such low Flow Numbers by using relatively low volume machine tool and hand tool operations in connection with high magnification and examination techniques. This was a labor-intensive process with a high rejection or scrap rate.

One technique which has overcome this problem and produces spray nozzles having Flow Numbers as low as 0.1 lb/hr.psi$^{0.5}$ is described and illustrated in U.S. Pat. No. 5,435,884. In this patent, which is owned by the assignee of the present application, a nozzle having a small swirl chamber, exit orifice and feed slots is provided that produces a fine droplet spray. The swirl chamber, exit orifice and feed slots are formed by chemical etching the surfaces of a thin metal plate. The etching produces a nozzle with very streamlined geometries thereby resulting in significant reductions in pressure losses and enhanced spray performance. The chemical etching process is easily repeatable and highly accurate, and can produce multiple nozzles on a single plate for individual or simultaneous use.

The nozzle shown and described in the '884 patent has many advantages over the prior art, mechanically-formed nozzles, and has received acceptance in the marketplace.

The nozzle has design features that allow it to be integrated into an affordable multi-point fuel injection scheme. Nevertheless, the power generation industry is faced with increasingly stringent emissions requirements for ozone precursors, such as nitrogen oxides (NOX) and carbon monoxide (CO). To achieve lower pollutant emissions, gas turbine manufacturers have adopted lean premixed (LP) combustion as a standard technique. LP combustion achieves low levels of pollutant emissions without additional hardware for steam injection or selective catalytic reduction. By premixing the fuel and air, localized regions of near stoichiometric fuel-air mixtures are avoided and a subsequent reduction in thermal NOX can be realized.

To achieve lower levels of NOX emissions, homogeneous fuel-air mixture distributions are necessary. While the nozzle shown in the '884 patent is appropriate for many applications, it does not have an integral air swirler allowing the introduction of the fuel spray into an air flow.

While many of the known air swirlers could be used with the nozzle shown in the '884 patent, such known air swirlers are typically produced by machining or otherwise mechanically-forming the air passages, which would substantially increase the weight and size of the nozzle in the '884 patent. Such swirlers would also be difficult to manufacture in small detail because of the aforementioned problems associated with conventionally machining small parts.

It is therefore believed there is a demand for an injector with a nozzle that provides a spray of fine droplets of a first fluid, and includes integral, compact and lightweight structure that allows the introduction of a second fluid into or in conjunction with the first fluid. It is further believed that there is a demand, particularly for gas turbine applications, for an injector that has a nozzle with a low Flow Number and has an integral, compact and light-weight air swirler to reduce NOX and CO emissions, improve spray patternization, and provide a spray that is well dispersed for efficient combustion.

SUMMARY OF THE INVENTION

The present invention provides a novel and unique injector with a nozzle that provides a spray of fine droplets of a first fluid, and includes integral, compact and lightweight structure that allows the introduction of a second fluid into or in conjunction with the first fluid. According to one application of the invention, an injector for gas turbine applications having a nozzle with a low Flow Number is provided, together with an integral, compact and lightweight air swirler. The injector reduces NOX and CO emissions, provides good spray patternization and the spray is well dispersed for efficient combustion. In addition, the injector can be accurately and repeatably manufactured.

According to the present invention, the injector includes a plurality of thin, flat plates of etchable material disposed in adjacent, surface-to-surface contact with one another. At least one, and preferably a plurality of nozzles are formed in the plates. Each of the nozzles includes a metering set formed in one or more of the plates and providing a fine spray of a first fluid. The injector also includes an integral swirler structure formed in one or more of the plates. The swirler structure allows the introduction of a second fluid into or in conjunction with the first fluid.

The metering set preferably includes a bowl-shaped swirl chamber shaped by etching at least one of the plates. Chemical etching, electromechanical etching or other appropriate etching technique can be used to form the swirl chamber. A spray orifice, also preferably formed by etching, is in fluid communication with the center of the swirl chamber. At least one feed slot, also preferably formed by etching, is in fluid communication with the swirl chamber and extends in non-radial relation thereto. Fluid directed through the feed slot(s) moves in a vortex motion toward the-center of the swirl chamber, and then exits the spray orifice in the conical spray of fine droplets.

The swirler structure preferably provides the second fluid with a swirling component of motion. The swirler structure preferably includes a cylindrical swirler passage, also shaped by etching through at least one of the other plates. The cylindrical swirler passage is located in co-axial relation to the spray orifice of the metering set, such that the first fluid from the spray orifice passes through the swirler passage. At least one feed slot, also preferably formed by etching, is provided in fluid communication with the swirler passage and extends in non-radial relation thereto. The second fluid is provided through the feed slot and moves in a swirling motion in the swirler passage. The second fluid imparts a swirling component of motion to the first fluid as the first fluid passes through the swirler passage.

The swirler structure is preferably formed in multiple plates of the injector. Each of the plates defines a portion of the swirler passage, with the plates arranged such that the portions are in co-axial relation with one another. Each swirler passage portion can have the same diameter and dimension, or could have different diameters and/or dimensions, such as to create a conical, tapered, elliptical, or other geometry swirler passage, to further enhance the mixing of the fluids.

Each of the plates of the swirler structure further preferably includes a plurality of feed slots in fluid communication with respective swirler passage portions and extending in non-radial relation thereto for supplying multiple fluid streams to the swirler passage. The feed slots can be provided in one or more multiple plates depending upon the desired amount of the second fluid and the swirl component to be imparted to the first fluid. The feed slots can be oriented to provide fluid streams in the same direction (co-rotating), or in opposite directions (counter-rotating).

Supply passages for the second fluid extend through the plates of the metering set and the swirler structure to the feed slots in each plate of the swirler structure. Each supply passage can also feed slots of adjacent swirler passages, such that multiple nozzles can be formed in a small area to reduce the overall size of the injector.

Injectors constructed according to the present invention are lightweight and compact, and can be used to introduce a second fluid into a first fluid spray. In gas turbine applications, the injector can be used to introduce a fuel spray into a swirling air flow. The swirling air enhances mixing, thereby resulting in reductions in NOX and CO emissions from the gas turbine engine. The swirling flow also enhances flame stability by generating toroidal recirculation zones that bring combustion products back towards the fuel injection apparatus thereby resulting in a sustained combustion and a stable flame. The swirling flow also provides good spray patternization and the spray is well-dispersed for efficient combustion. The etching of the plates of the swirler structure (and of the metering set) is accurate and repeatable.

Further features of the present invention will become apparent to those skilled in the art upon reviewing the following specification and attached drawings

DESCRIPTION OF THE PREFERRED EMBODIMENTS

Figure 1:
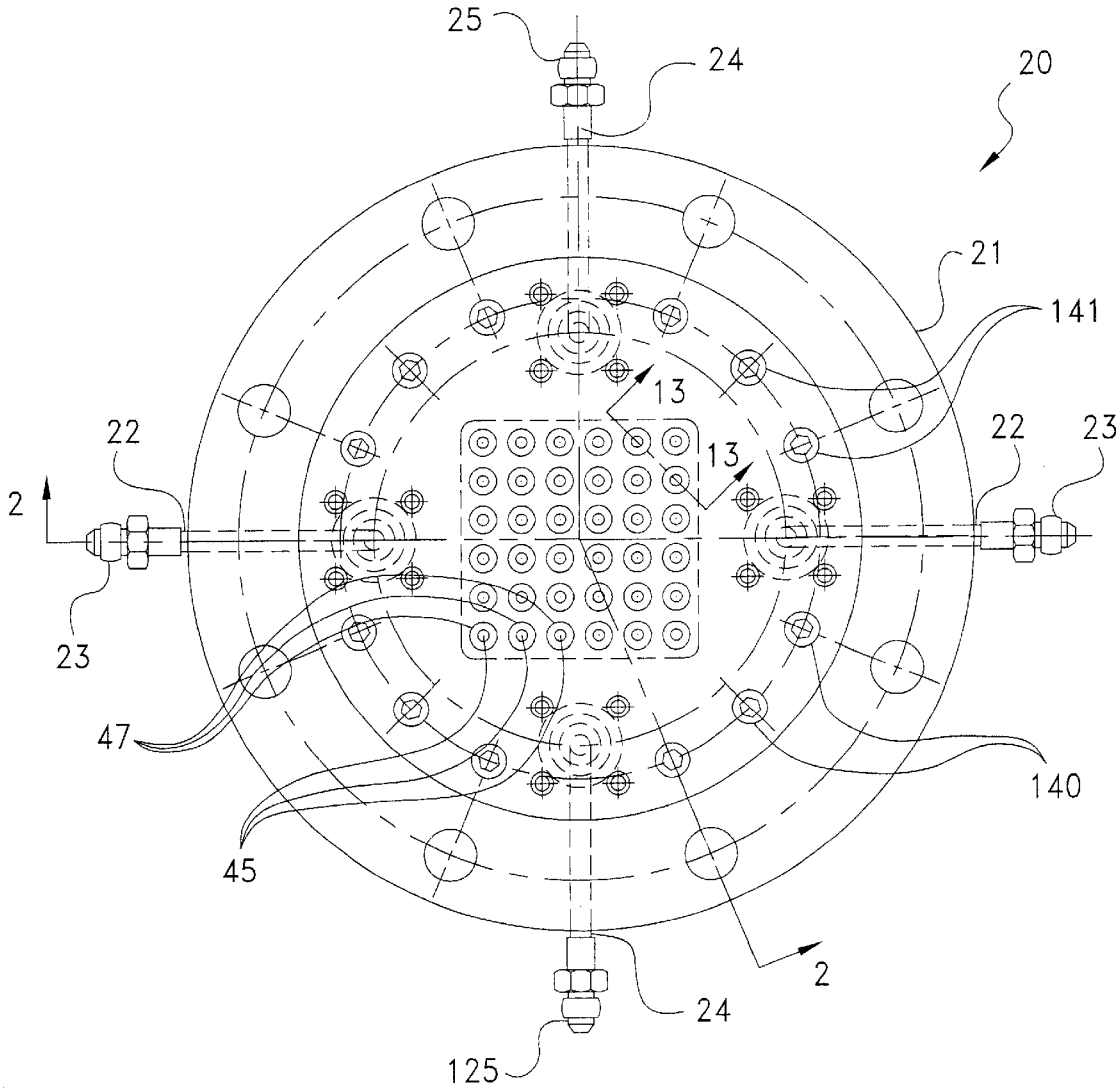
FIG. 1 is a plan view of an injector constructed in accordance with the present invention.
Figures 2, 3:
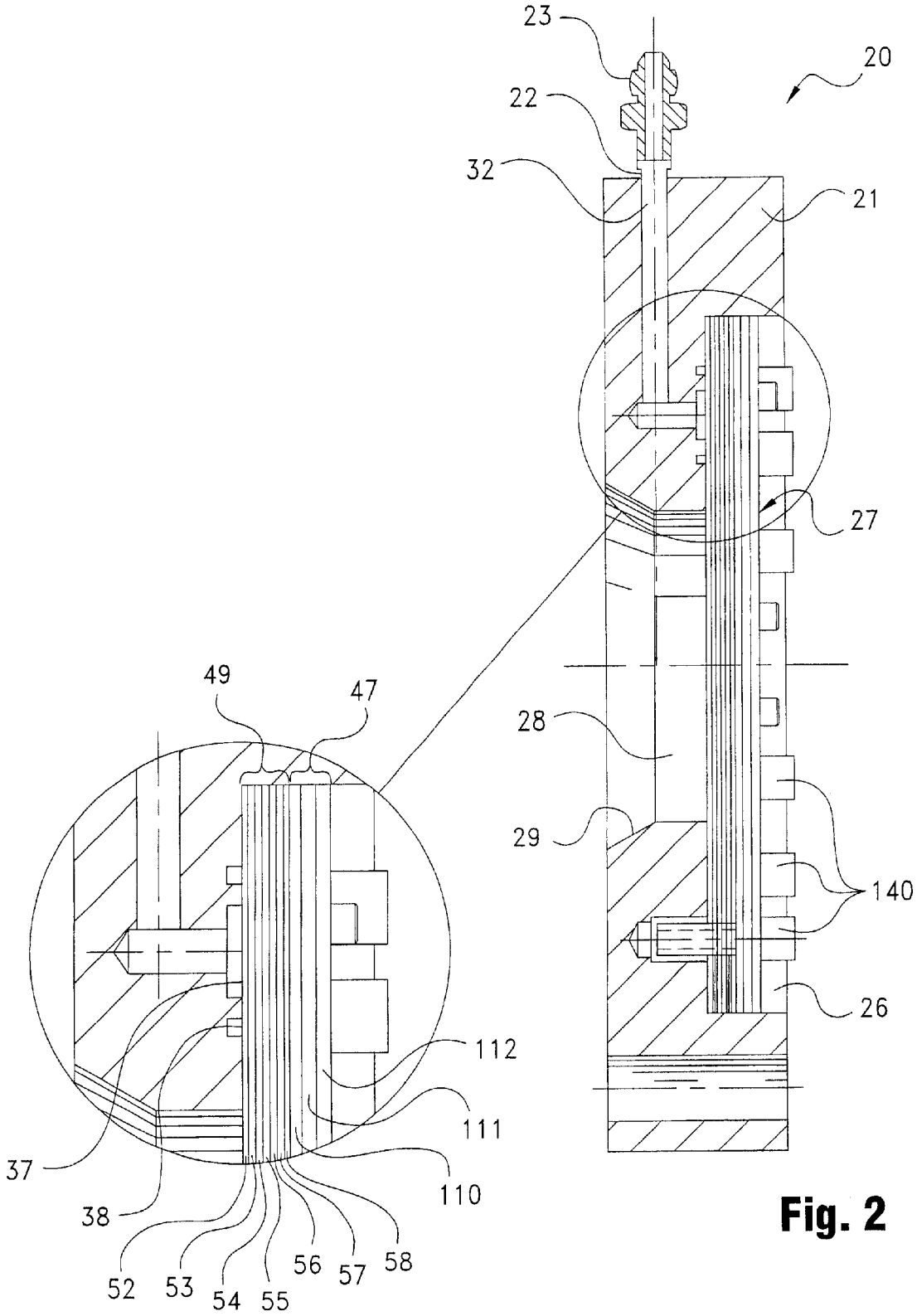
FIG. 2 is a cross-sectional side view of the injector taken substantially along the plane defined by the lines 2—2 of FIG. 1.
FIG. 3 is an enlarged cross-sectional side view of a portion of the injector.

Referring initially to FIGS. 1 and 2, an injector formed in accordance with the present invention is indicated generally at 20. The injector 20 is particularly suited for dispensing liquid fuel in gas turbine engines, however the injector is useful in other combustion applications, such as in fluid hydrocarbon burners, where a fine dispersion of fuel droplets of two fluids (i. e., a liquid fuel and air) is desirable. While the terms "fuel" and "air" are used to describe two fluids useful in the preferred embodiment of the present invention, it should be appreciated that these fluids are only examples of the fluids that can be directed through the injector, and that the present invention is applicable to a wide variety of fluids for many different applications.

The injector 20 preferably includes an injector body 21, with one or more fuel tubes or pipes 22, each of which has a fitting as at 23 to enable the pipe(s) to be connected to receive fuel in the engine. The injector further preferably has one or more cooling fluid pipes 24, also with fittings 25, to receive cooling fluid (e.g., air or water) in the engine. Preferably pipes 22, 24 are connected to injector body 21 in an appropriate manner, such as by brazing.

The injector body 21 has a central cavity 26 opening toward the downstream side of body 21, and which receives an injector plate assembly, indicated generally at 27. The body 21 further includes a central air passage 28 extending through the body, and which is oriented within the combustor of the engine such that combustion air is directed through passage 28 and against plates 27. The passage 28 can be outwardly flared or tapered as at 29 at the upstream end of the body 21 to increase the amount of air directed through the passage. A drilled passage as at 32 interconnects each pipe 22, 24 with the body cavity 26 such that fuel is directed through inlet pipes 22 to fuel inlet passages 35 (FIG. 5B) in the plate assembly 27, while cooling fluid is directed through pipes 24 to cooling fluid inlet passages 36 (FIG. 5B) in the plate assembly 27. Annular seals 37, 38 are provided in surrounding relation to passage 35, 36 to provide a fluid-tight seal between injector body 21 and injector plate assembly 27.

A plurality of spray nozzles, for example as indicated at 45, are provided in the injector for dispensing the fuel in a fine spray. The spray nozzles are preferably arranged in an even, spaced apart manner across a portion of the plate assembly. While spray nozzles 45 are shown in a square arrangement, it should be appreciated that this is only for illustration purposes, and the arrangement and number of spray nozzles can vary depending upon the particular application. As will be described below, the injector also has an integral swirler structure, for example as indicated generally at 47, in surrounding relation to each spray nozzle, which directs air in a swirling manner into the fuel spray from each nozzle.

Each spray nozzle 45 is formed in a fuel metering set, indicated generally at 49 in FIG. 3, which includes at least one of plates 52–58 of assembly 27. An upstream seal support plate 52 is located adjacent the inner wall of injector body cavity 26; a bottom cooling plate 53 is located downstream from and adjacent seal support plate 52; a lower fuel manifold plate 54 is located downstream from and adjacent bottom cooling plate 53; an upper fuel manifold plate 55 is located downstream from and adjacent lower fuel manifold plate 54; a fuel feed manifold plate 56 is located downstream from and adjacent upper fuel manifold plate 55; a fuel swirler plate 57 is located downstream from and adjacent fuel feed manifold 56; and an upper cooling plate 58 is located downstream from and adjacent fuel swirler plate 57. Plates 52–58 are all fixed together, such as by high-temperature brazing, and direct fuel from inlet passages 35 (FIG. 5B) in plate 52 to spray nozzles 45 (FIG. 1).

Figure 4A:
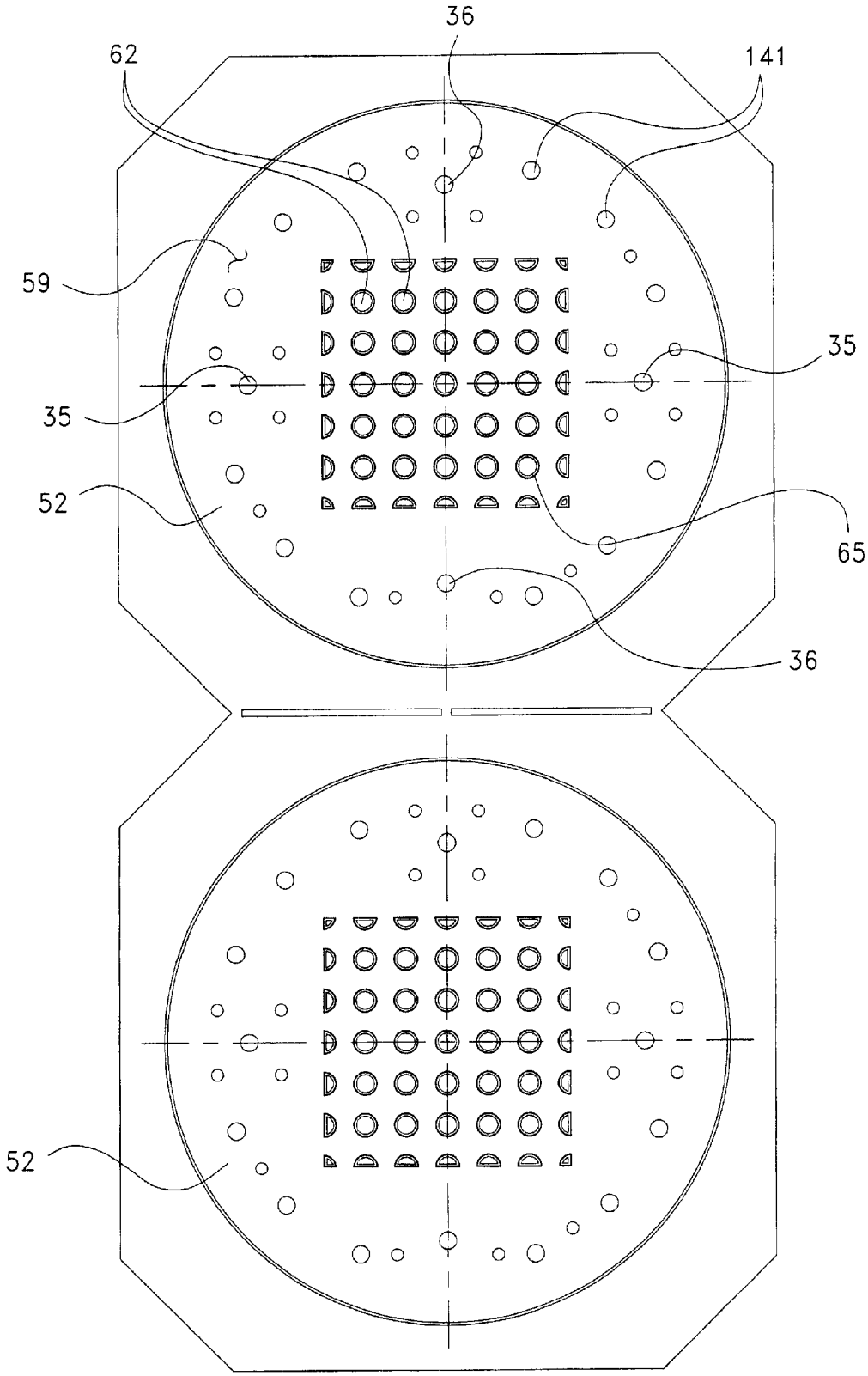
FIG. 4A is a front plan view of a first of the plates of the metering set of the injector.
Figure 4B:
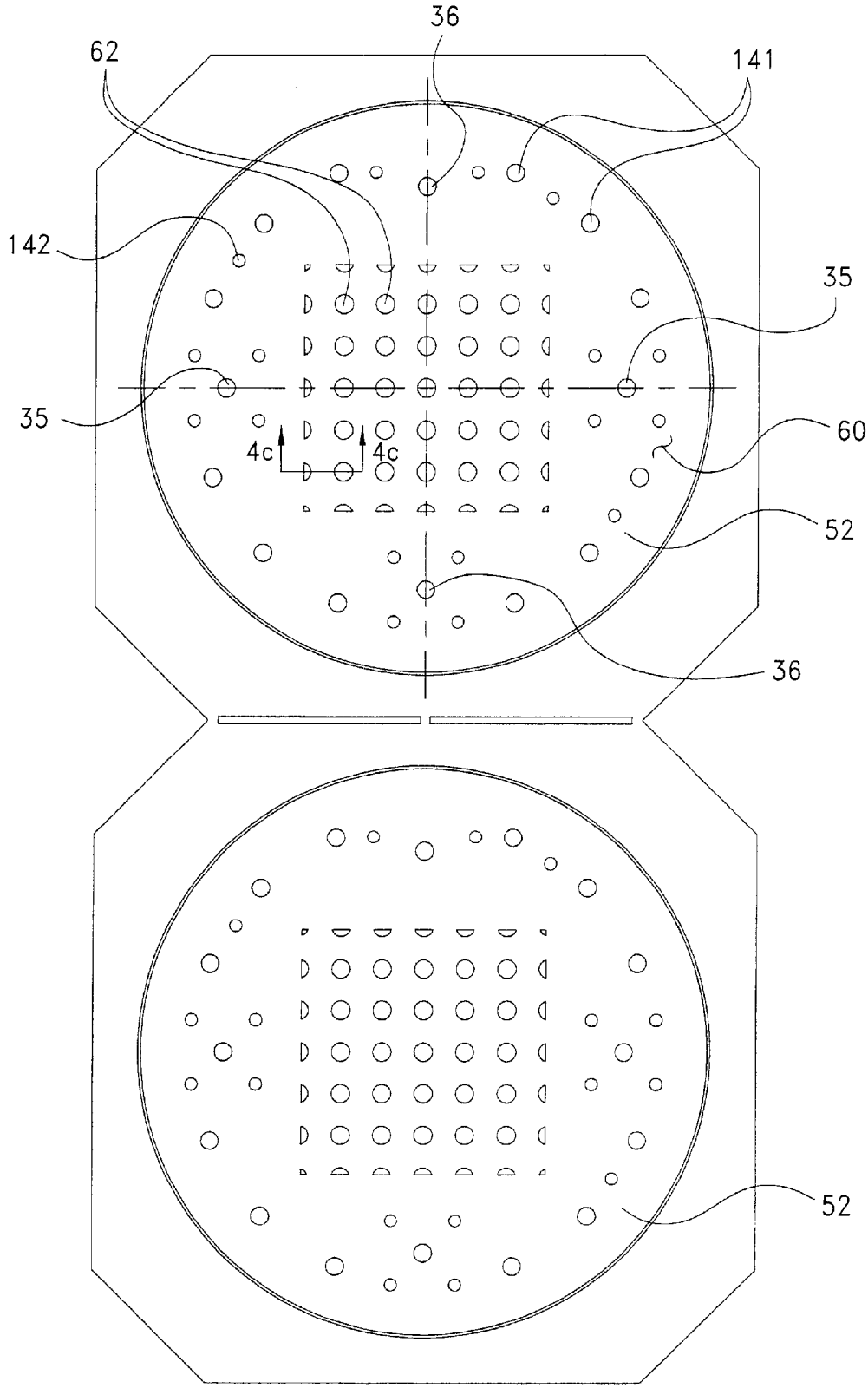
FIG. 4B is a rear plan view of the first plate of the metering set.
Figure 4C:
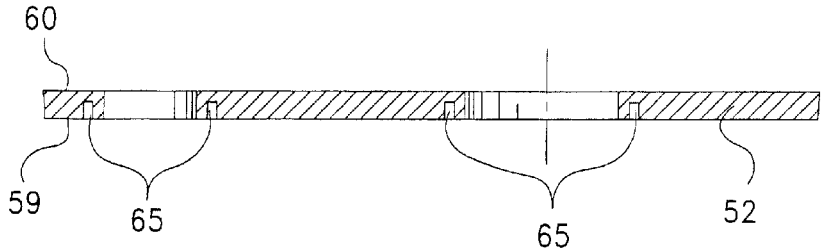
FIG. 4C is a cross-sectional side view of a portion of the first plate, taken substantially along the plane described by the lines 4C—4C of FIG. 4B.
Figure 5C:
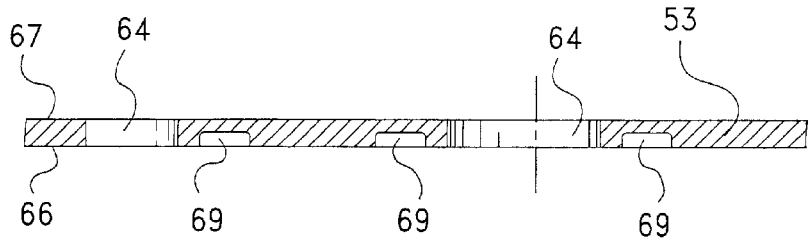
FIG. 5C is a cross-sectional side view of a portion of the second plate, taken substantially along the plane described by the lines 5C—5C of FIG. 5B.
Figure 5A:
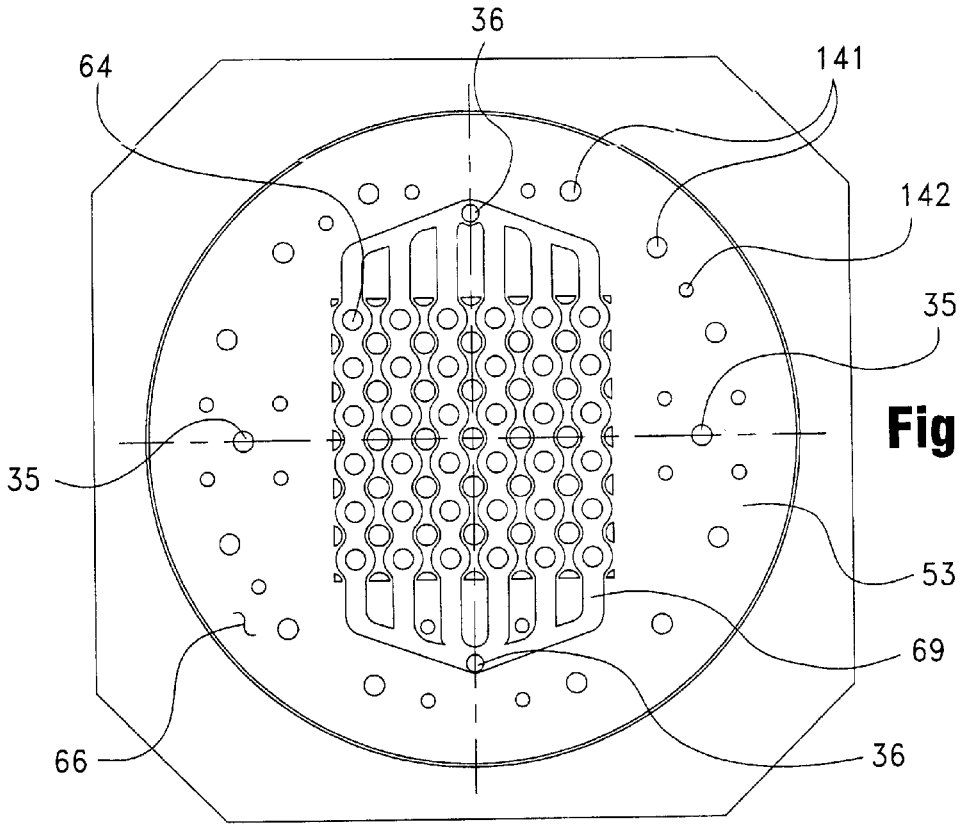
FIG. 5A is a front plan view of a second of the plates of the metering set.
Figure 5B:
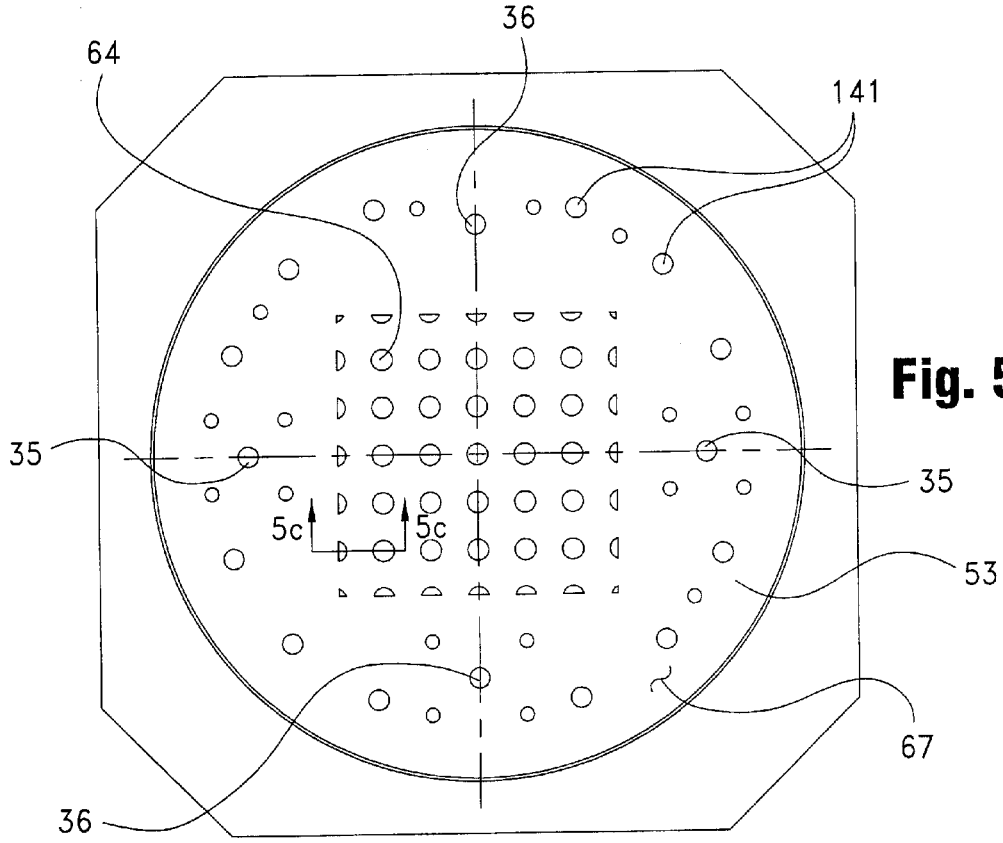
FIG. 5B is a rear plan view of the second plate.

As shown in FIGS. 4A and 4B, the upstream seal support plate 52 has a front (downstream) surface 59, a rear (upstream) surface 60 adjacent the inner wall of body cavity 26, and a plurality of cylindrical through-passages as at 62 extending from front surface 59 to back surface 60 for directing air received through combustion air passage 28 to the swirler structure. Passages 62 are preferably arranged in an even, spaced-apart manner, and partial passages may be provided along the edges of the arrangement, depending upon the location of the spray nozzles. Passages 62 in seal support plate 52 are axially and fluidly aligned with cylindrical passages 64 in bottom cooling plate 53 (FIG. 5A, 5B). An annular air channel or gap 65 (FIGS. 4A, 4C) is formed in front surface 59 surrounding each of the through-passages 62 to provide thermal isolation with the adjacent cooling plate 53.

Figure 6C:
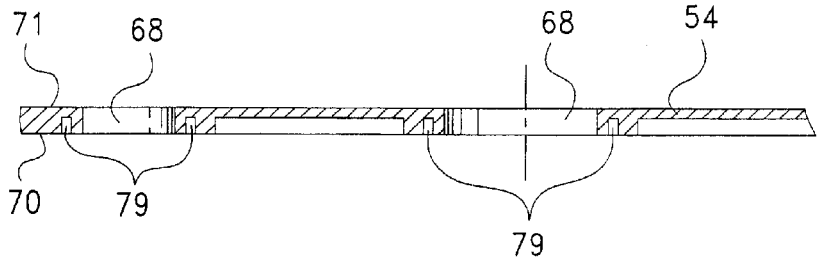
FIG. 6C is a cross-sectional side view of a portion of the third plate, taken substantially along the plane described by the lines 6C—6C of FIG. 6B.
Figure 6A:
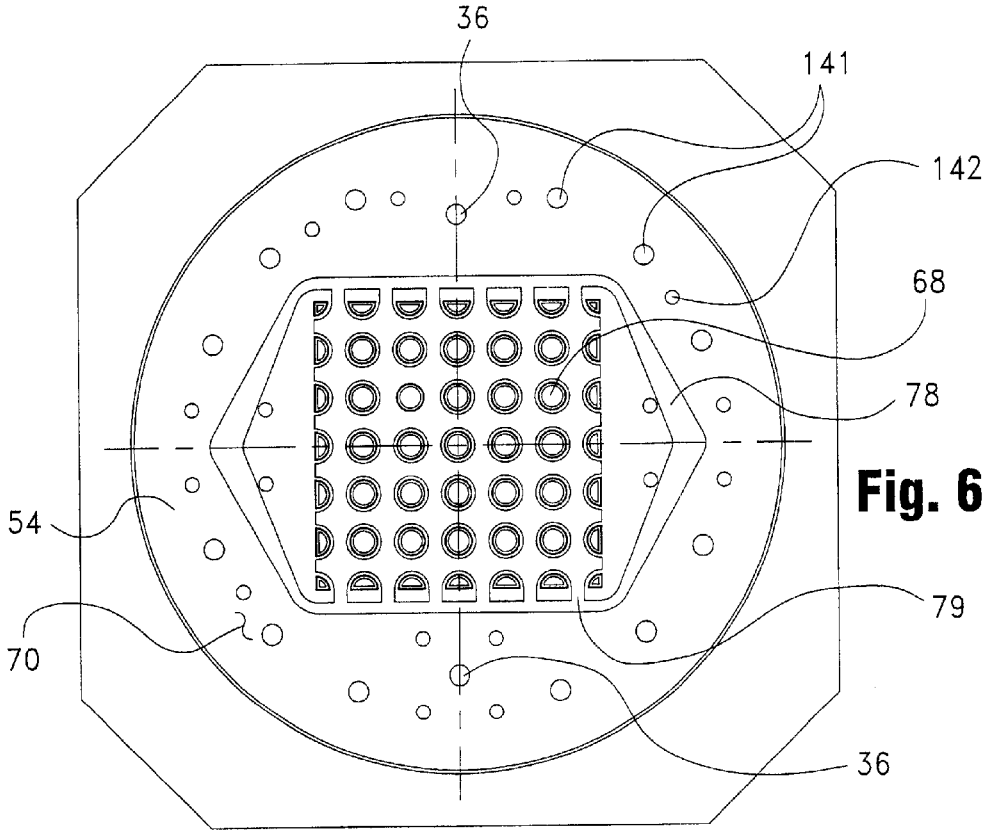
FIG. 6A is a front plan view of a third of the plates of the metering set.
Figure 6B:
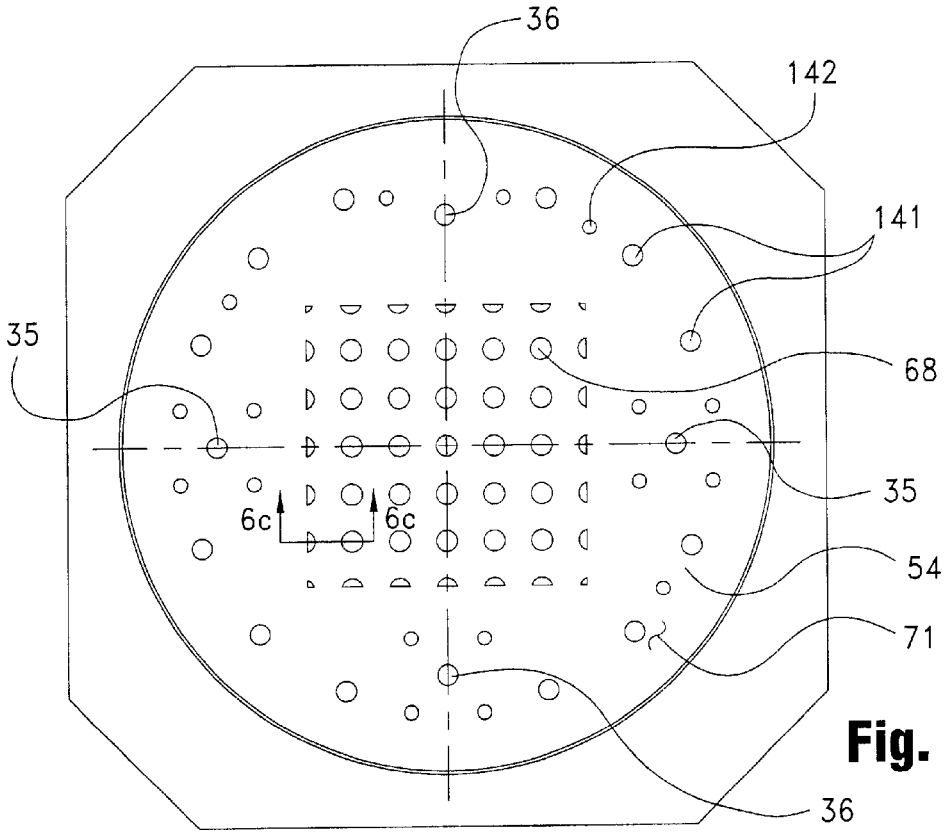
FIG. 6B is a rear plan view of the third plate.

Referring now to FIGS. 5A and 5B, the bottom cooling plate 53 has a front (downstream) surface 66, and a rear (upstream) surface 67 adjacent the front surface 59 of seal support plate 52. Passages 64 in bottom cooling plate 53 are also arranged in an even, spaced-apart manner, and partial air passages may be provided along the edges of the arrangement. Passages 64 in bottom cooling plate 52 are axially and fluidly aligned with cylindrical passages 68 in lower fuel manifold plate 54 (FIG. 6A, 6B). Cooling channels 69 (FIGS. 5A, 5C) are formed on the front surface 66 of plate 53. Channels 69 direct cooling fluid from cooling fluid passages 36 across the surface of the plate, at least in the areas surrounding air passages 64.

Figure 7C:
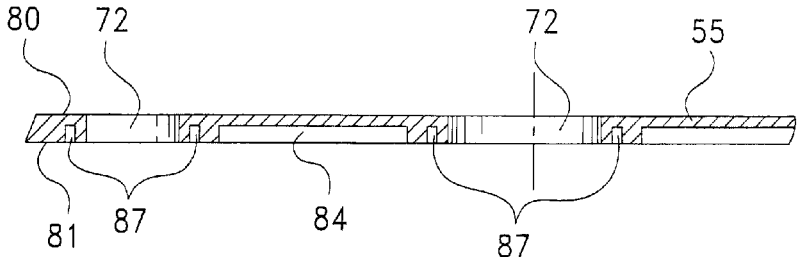
FIG. 7C is a cross-sectional side view of a portion of the fourth plate, taken substantially along the plane described by the lines 7C—7C of FIG. 7B.
Figure 7D:
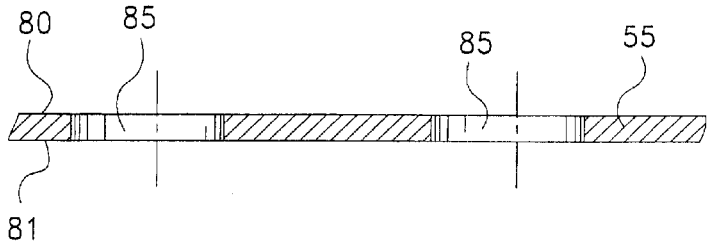
FIG. 7D is a cross-sectional side view of a portion of the fourth plate, taken substantially along the plane described by the lines 7D—7D of FIG. 7B.
Figure 7A:
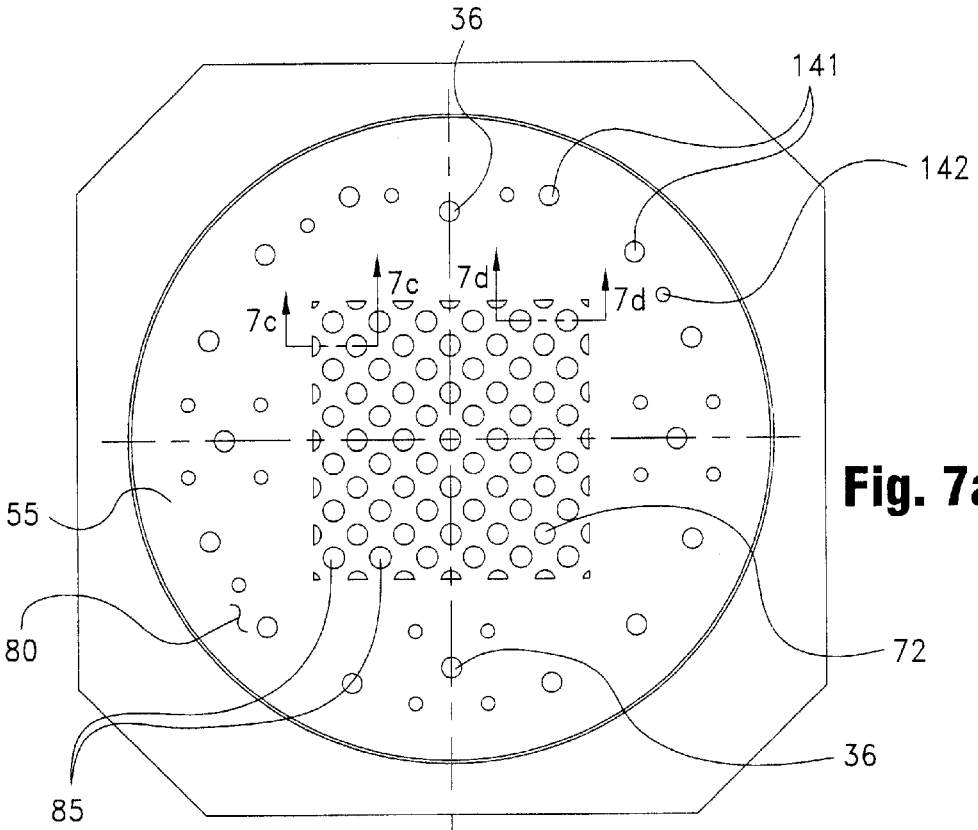
FIG. 7A is a front plan view of a fourth of the plates of the metering set.
Figure 7B:
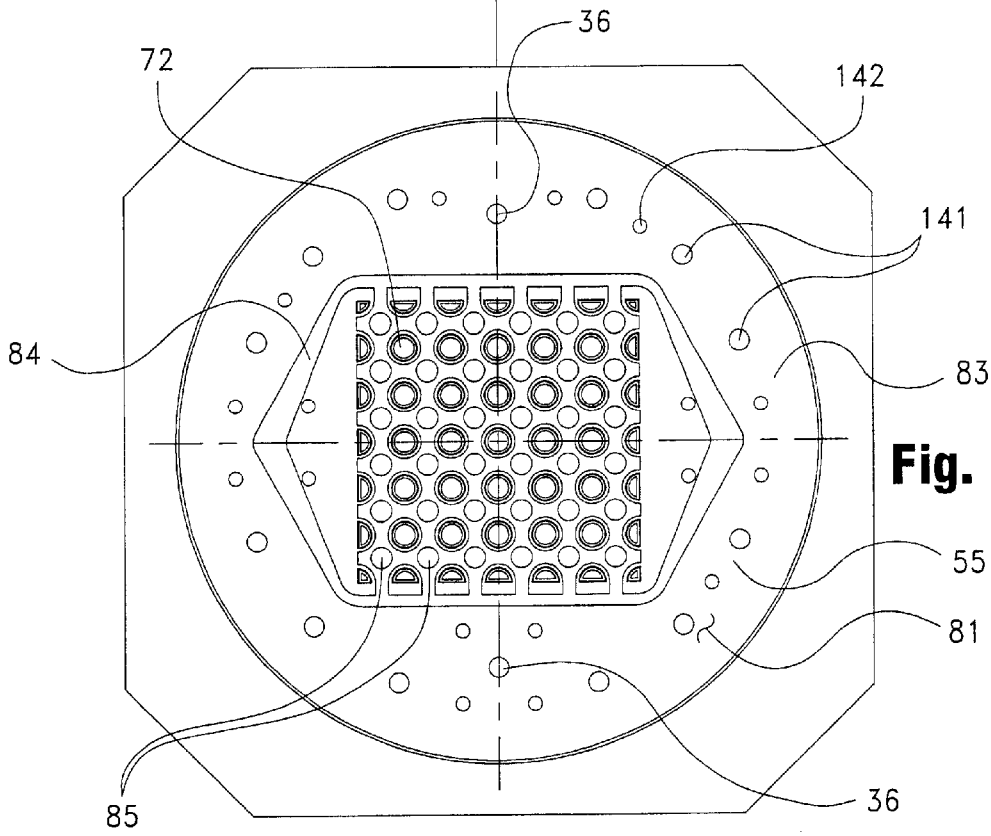
FIG. 7B is a rear plan view of the fourth plate.

As shown in FIG. 6A and 6B, the lower fuel manifold plate 54 has a front (downstream) surface 70, and a rear (upstream) surface 71 adjacent the front surface 66 of bottom cooling plate 53. Passages 68 in lower fuel manifold plate 54 are also arranged in an even, spaced-apart manner, and partial passages may be provided along the edges of the arrangement. Passages 68 in lower fuel manifold plate 54 are axially and fluidly aligned with cylindrical passages 72 in adjacent upper manifold plate 55 (FIGS. 7A, 7B). Lower fuel manifold plate 54 further includes fuel channels 78 in the front surface 70 (FIGS. 6A, 6C) which direct fuel from inlet fuel passage 35 in the area surrounding air passages 68. An annular air channel or gap 79 (FIGS. 6A, 6C) is formed in front surface 70 surrounding each of the through-passages 68 to provide a thermal isolation seal with the adjacent upper fuel manifold plate 55.

Figure 8C:
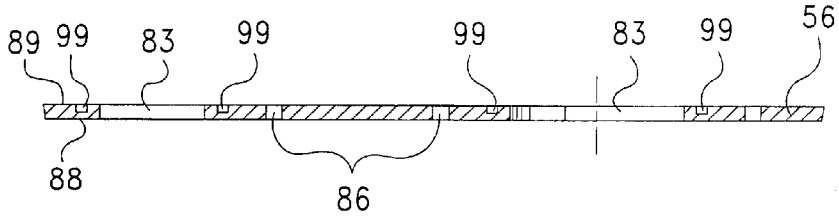
FIG. 8C is a cross-sectional side view of a portion of the fifth plate, taken substantially along the plane described by the lines 8C—8C of FIG. 8B.
Figure 8A:
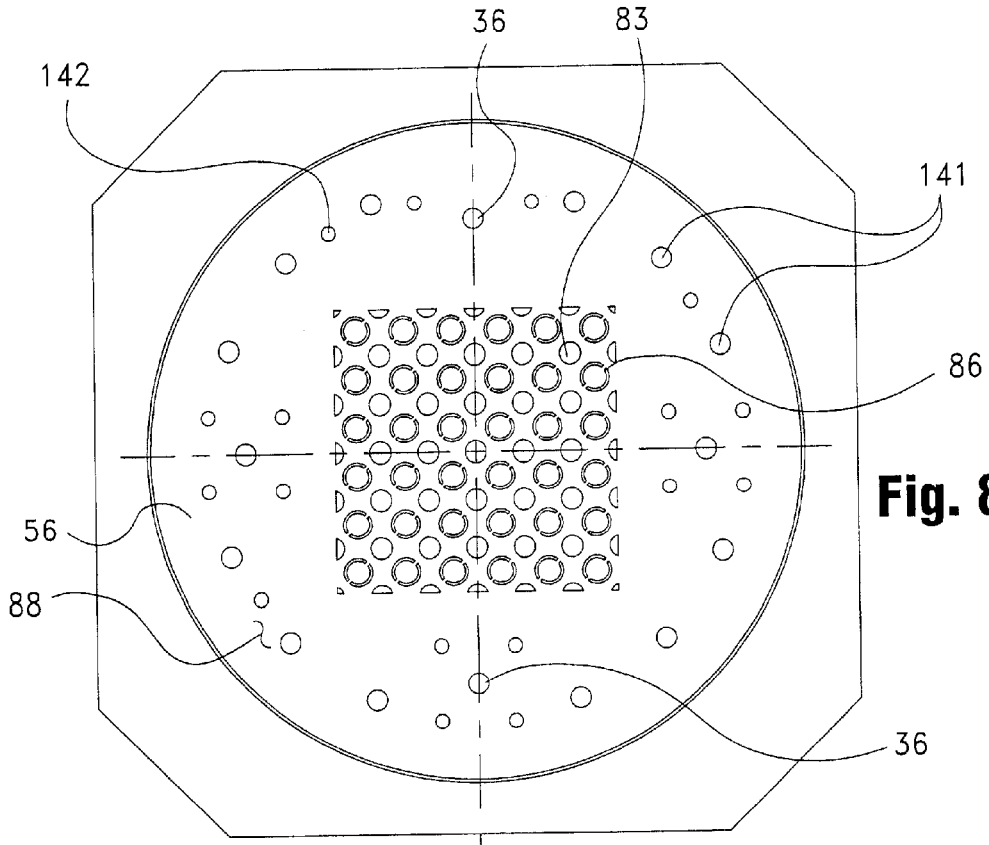
FIG. 8A is a front plan view of a fifth of the plates of the metering set.
Figure 8B:
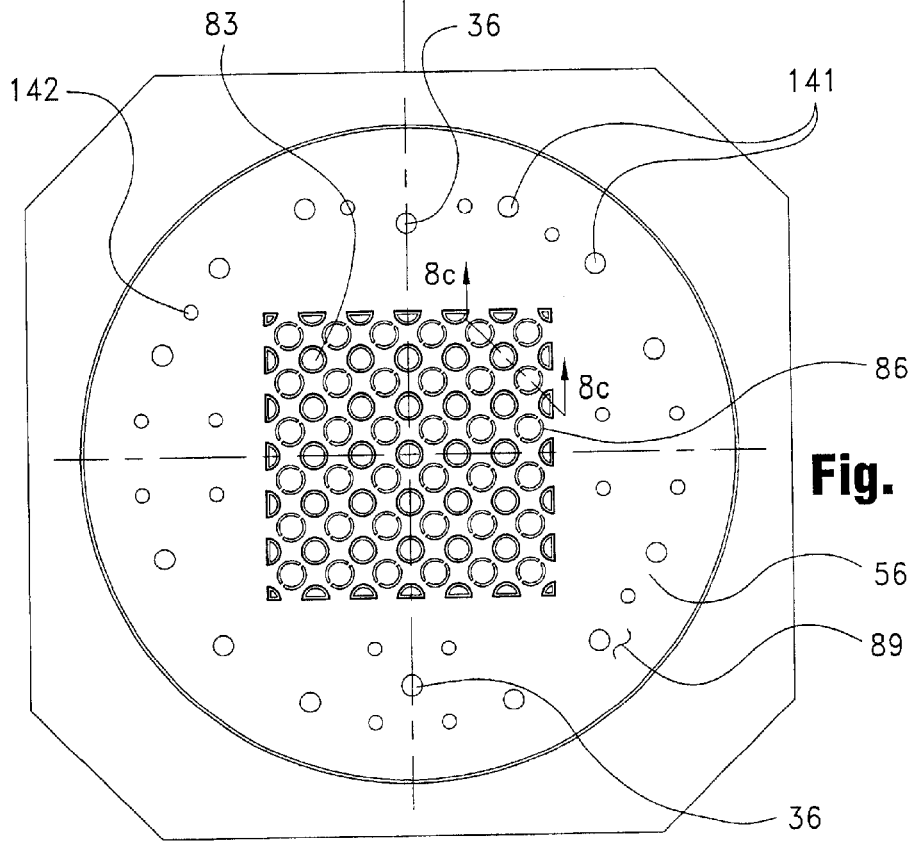
FIG. 8B is a rear plan view of the fifth plate.

As shown in FIGS. 7A and 7B, the upper fuel manifold plate 55 has a front (downstream) surface 80, and a rear (upstream) surface 81 adjacent the front surface 70 of lower fuel manifold plate 54. Passages 72 in upper fuel manifold plate 55 are also arranged in an even, spaced-apart manner, and partial passages may be provided along the edges of the arrangement. Passages 72 in upper fuel manifold plate 55 are axially and fluidly aligned with cylindrical passages 83 in adjacent fuel feed manifold plate 56 (FIGS. 8A, 8B). Upper fuel manifold plate 55 further includes fuel channels 84 in the rear surface 81 (FIGS. 7B, 7C) which align with fuel channels 78 in the front surface 70 of lower fuel manifold plate 54 (FIG. 6A) to direct fuel from inlet fuel passage 35 in the area surrounding air passages 72. Cylindrical fuel passages 85 (FIGS. 7A, 7D) are also provided in upper fuel manifold plate 55. Fuel passages 85 are also arranged in an even, spaced-apart manner across the plate, and are fluidly connected to channels 84 on plate 55, and to cylindrical fuel passages 86 in adjacent fuel feed manifold plate 56 (FIGS. 8A, 8B). An annular air channel or gap 87 (FIGS. 7B, 7C) is formed in rear surface 81 surrounding each of the through-passages 72 to provide thermal isolation with the adjacent lower fuel manifold plate 54.

Figure 9A:
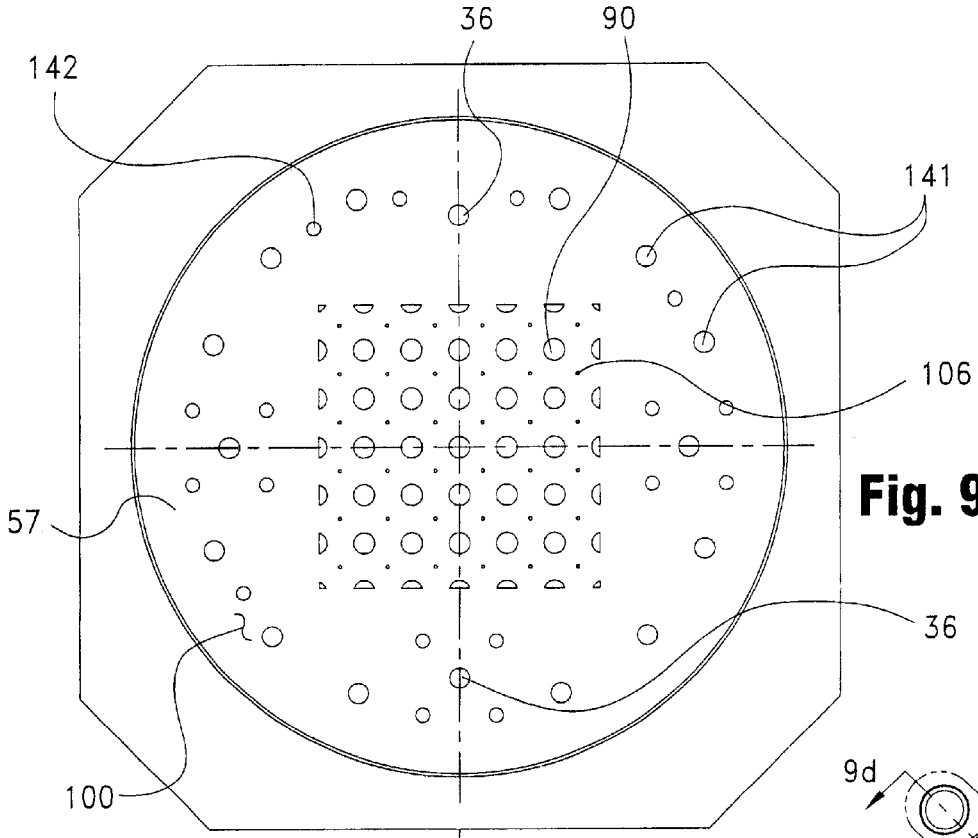
FIG. 9A is a front plan view of a sixth of the plates of the metering set.
Figure 9C:
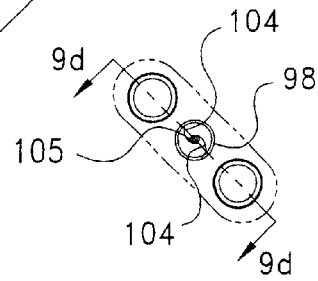
FIG. 9C is a cross-sectional side view of a portion of the sixth plate, taken substantially along the plane described by the lines 9C—9C of FIG. 9B.
Figure 9B:
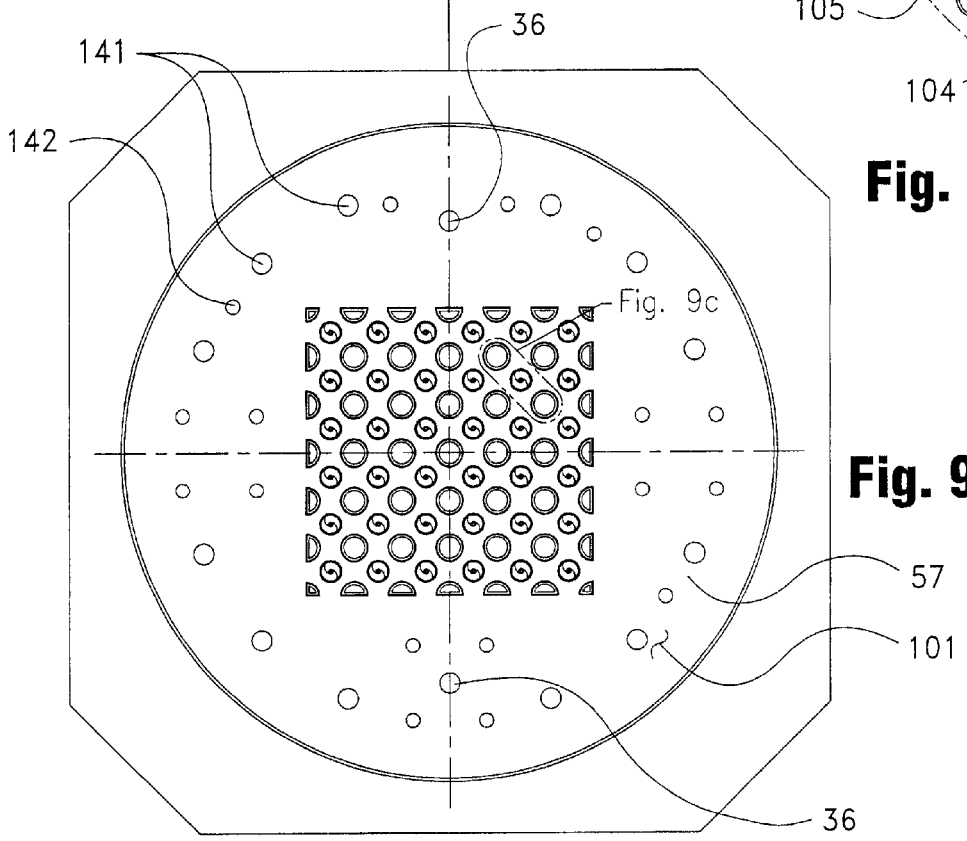
FIG. 9B is a rear plan view of the sixth plate.

As shown in FIGS. 8A, 8B, the fuel feed manifold plate 56 has a front (downstream) surface 88, and a rear (upstream) surface 89 adjacent the front surface 80 of upper fuel manifold plate 55. Passages 83 in fuel feed manifold plate 56 are also arranged in an even, spaced-apart manner, and partial passages may be provided along the edges of the arrangement. Passages 83 are axially and fluidly aligned with cylindrical passages 90 in adjacent fuel swirler plate 57 (FIGS. 9A, 9B). Fuel passages 86 are formed in arcuate-shaped pairs, and are fluidly aligned with a portion of an annular fuel channel 98 formed in fuel swirler plate 57 (FIG. 9C). An annular air channel or gap 99 (FIGS. 8B, 8C) is formed in rear surface 89 surrounding each of the through-passages 83 to provide thermal isolation with the adjacent fuel swirler plate 57.

Figure 9D:
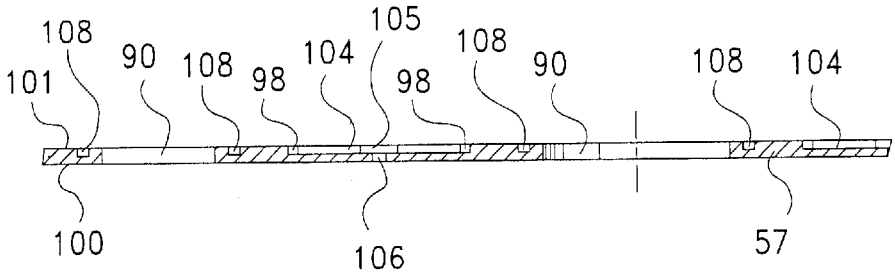
FIG. 9DC is a cross-sectional side view of a portion of the sixth plate, taken substantially along the plane described by the lines 9D—9D of FIG. 9C.
Figure 10C:
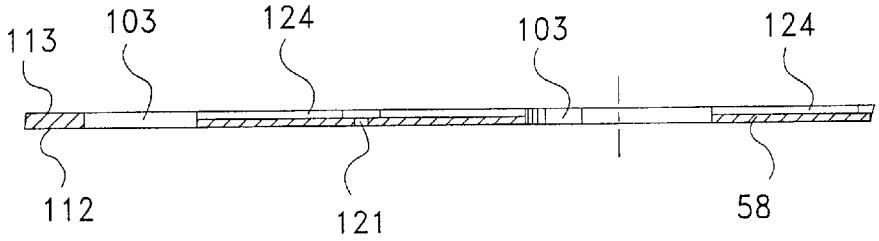
FIG. 10C is a cross-sectional side view of a portion of the seventh plate, taken substantially along the plane described by the lines 10C—10C of FIG. 10B.
Figure 11C:
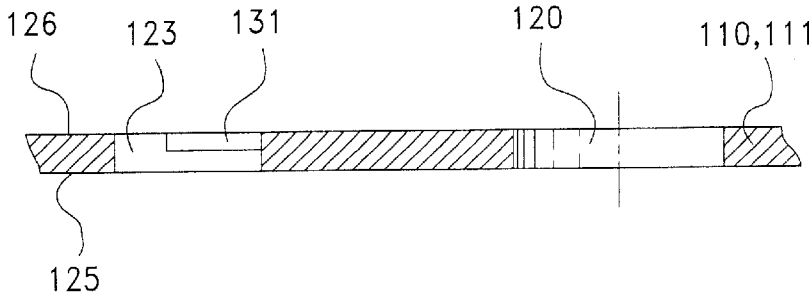
FIG. 11C is a cross-sectional side view of a portion of the first plate, taken substantially along the plane described by the lines 11C—11C of FIG. 11B.
Figure 10A:
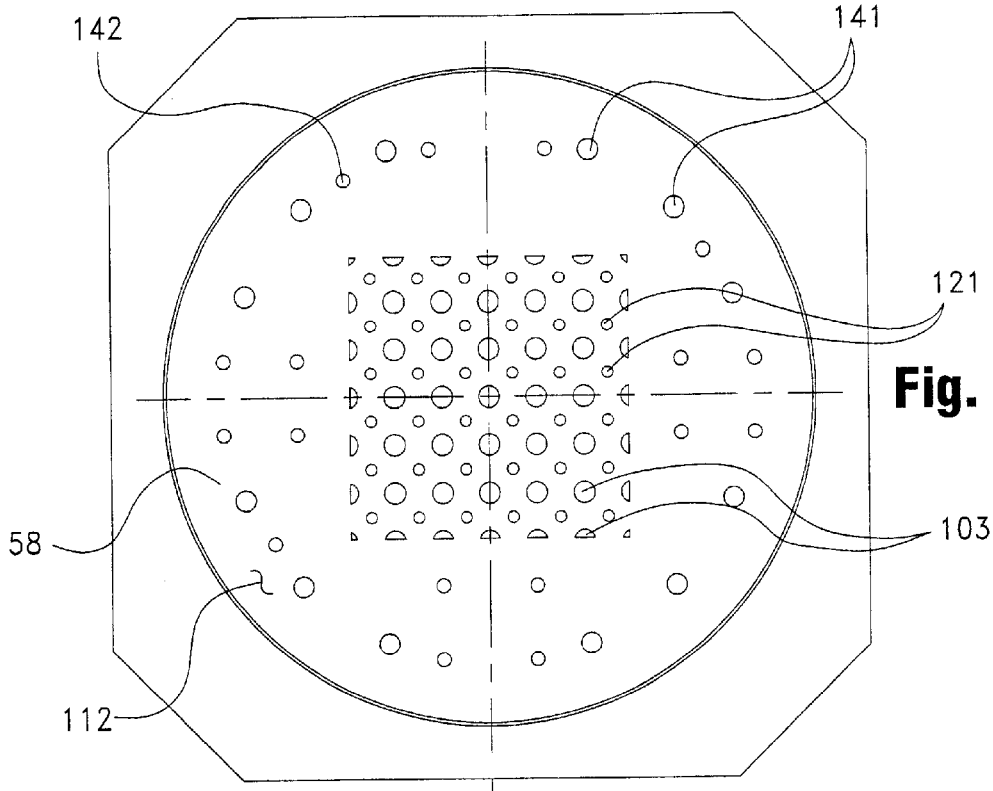
FIG. 10A is a front plan view of a seventh of the plates of the metering set.
Figure 10B:
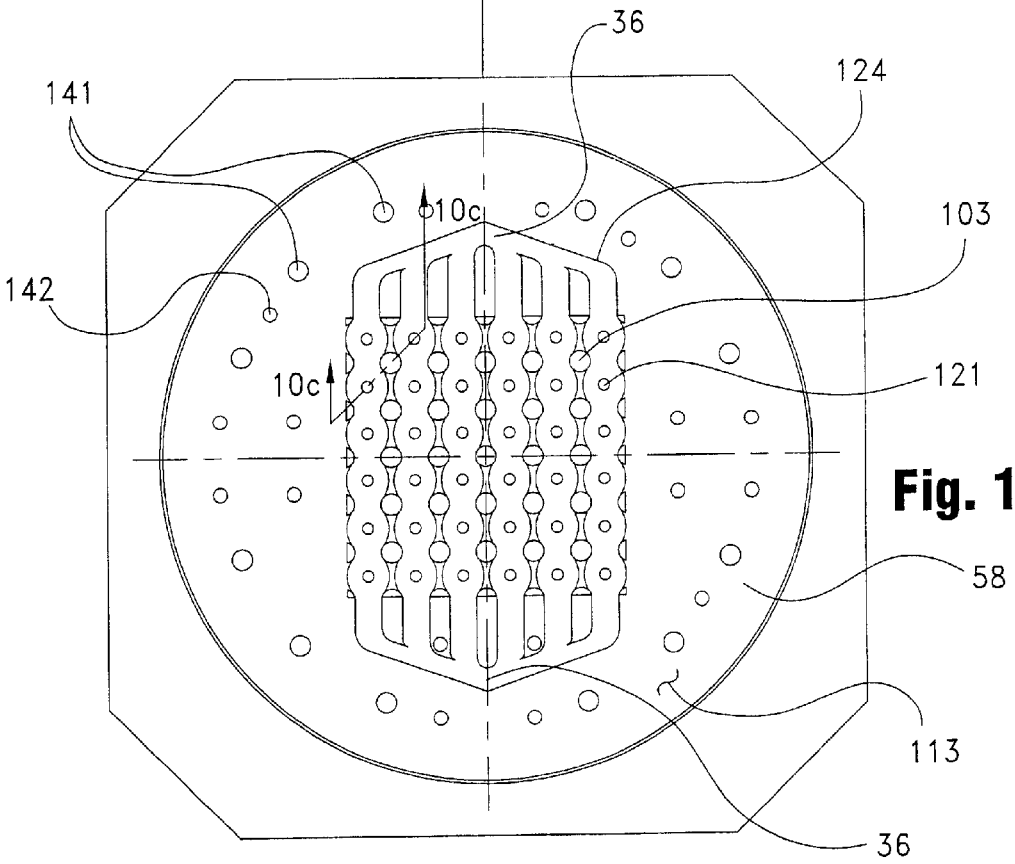
FIG. 10B is a rear plan view of the seventh plate.

As shown in FIGS. 9A, 9B, the fuel swirler plate 57 has a front (downstream) surface 100, and a rear (upstream) surface 101 adjacent the front surface 88 of fuel feed manifold plate 56. Passages 90 in fuel swirler plate 57 are also arranged in an even, spaced-apart manner, and partial passages may be provided along the edges of the arrangement. Passages 90 are axially and fluidly aligned with cylindrical passages 103 in adjacent upper cooling plate 58 (FIGS. 10A, 10B). Annular fuel channel 98 is formed in the rear surface 101 of fuel swirler plate 57. A pair of non-radial feed slots 104 direct fuel inward from fuel channel 98 to a central bowl-shaped swirl chamber 105. The angle of the inlet fuel feed slots 104 determines the swirling velocity to fluid supplied to the swirl chamber 105. A central spray orifice 106 extending to the front surface 100 (FIGS. 9A, 9D) is provided in the center of each swirl chamber 105. An annular air channel or gap 108 (FIGS. 9B, 9C) is formed in rear surface 101 surrounding each of the through-passages 90 to provide thermal isolation with the adjacent upper cooling plate 58.

Figure 11A:
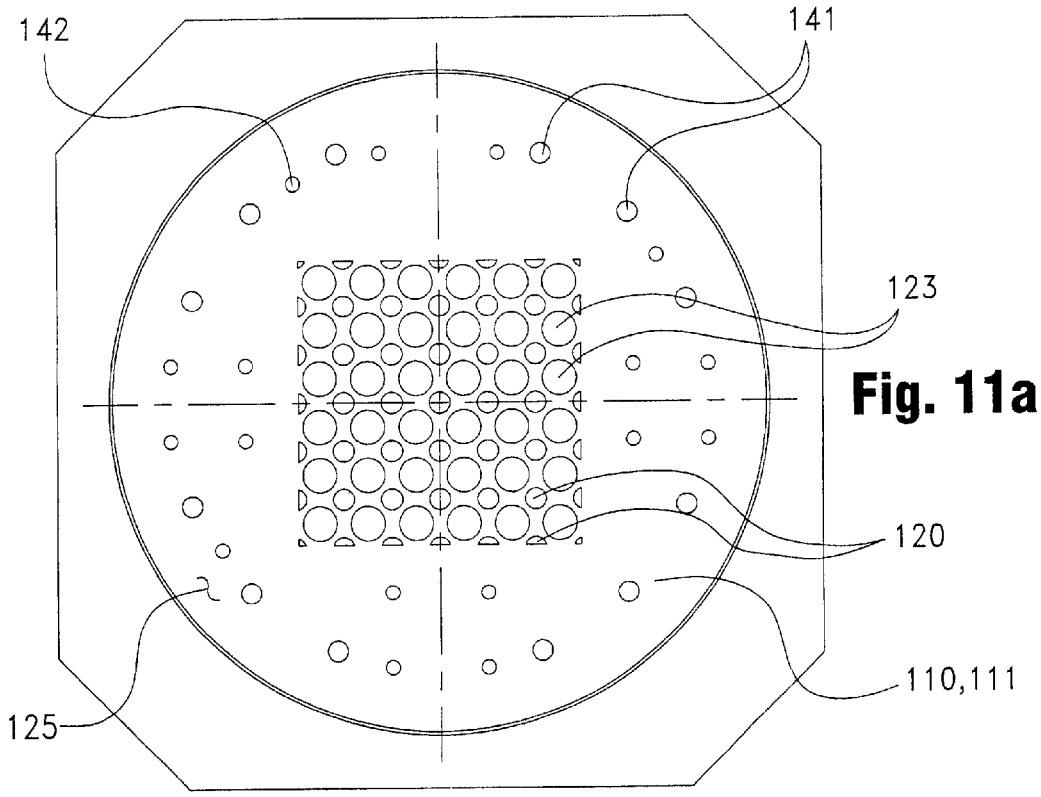
FIG. 11A is a front plan view of a first of the plates of the swirler structure, the second plate being identical.
Figure 11B:
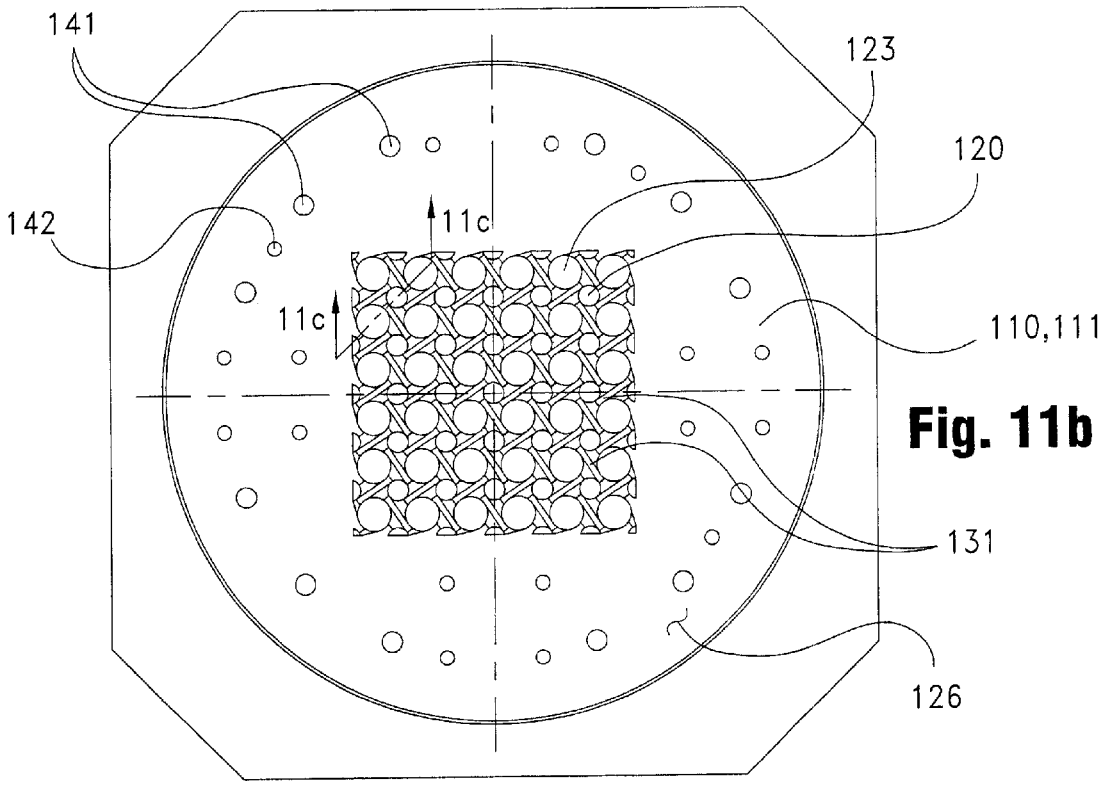
FIG. 11B is a rear plan view of the first plate.

Referring now to FIGS. 10A and 10B, the upper cooling plate 58 has a front (downstream) surface 112, and a rear (upstream) surface 113 adjacent the front surface 100 of fuel swirler plate 57. Passages 103 in upper cooling plate 58 are also arranged in an even, spaced-apart manner, and partial passages may be provided along the edges of the arrangement. Passages 103 in upper cooling plate 58 are axially and fluidly aligned with cylindrical passages 120 in a first upstream swirler plate 110 of the swirler structure (FIGS. 11A, 11B). Cylindrical fuel passages 121 are also provided in upper cooling plate 58. Passages 121 are also arranged in an even, spaced-apart manner across the plate, and are fluidly-aligned with orifices 106 on fuel swirler plate 57 and cylindrical swirler passages 123 on upstream swirler plate 110. Cooling channels 124 (FIGS. 10B, 10C) are formed on the rear surface 113 of plate 58. Channels 124 direct cooling fluid from cooling fluid passages 36 across the surface of the plate, at least in the areas surrounding air passages 103 and fuel passages 121.

As such, as described above, air directed through combustion air inlet 28 in body 21 is directed through air passages 62 in upstream seal support plate 52 (FIGS. 4A, 4B); passages 64 in bottom cooling plate 53 (FIGS. 5A, 5B); passages 68 in lower fuel manifold plate 54 (FIGS. 6A, 6B); passages 72 in upper fuel manifold plate 55. (FIGS. 7A, 7B3); passages 83 in fuel feed manifold plate 56 (FIGS. 8A, 8B): passages 90 in fuel swirler plate 57 (FIGS. 9A, 9B); and passages 103 in upper cooling plate 58 (FIGS. 10A, 10B). Fuel enters between fuel manifold plates 54 (FIG. 6A) and 55 (FIG. 7B) and is directed through passages 85 in upper fuel manifold plate 55. (FIG. 7A) and then through arcuate passages 86 in fuel feed manifold plate 56 (FIGS. 8A, 8B); and through annular fuel chamber 98 and fuel feed slots 104 into the swirl chamber 105 formed in fuel swirler plate 57, where the fuel is caused to form a vortex and is then directed out through the spray orifices 106 on the downstream side of the fuel swirler plate (FIG. 9A) in a conical spray. The fuel spray then passes through aligned passages 121 in upper cooling plate 58. Cooling fluid is provided between bottom cooling plate 53 and lower fuel manifold plate 54, as well as between fuel swirler plate 57 and upper cooling plate 58.

The air and fuel passages, fuel channels, swirl chambers, feed slots, and openings/orifices in each of the plates are preferably formed by etching through a thin sheet of etchable material, e.g., metal. Etching allows these passages to have uniformly rounded edges with no burrs which is conducive to efficient fluid flow. The swirl chamber 105 preferably has a bowl shape, while annulus 104 and inlet fuel slots 104 preferably have a trough shape with rounded walls. The trough shape of the fuel feed slots 104 blends with the rounded walls of the swirl chamber 105 to provide efficiency of fluid flow in the transition between the passages slots 104 and swirl chamber 105. The nozzle preferably has a Flow Number of 1.0 lb/hr.psi$^{0.5}$ or less. Further discussion of chemically and electromechanically etching a feed annulus, inlet slots and swirl chamber in a thin metal sheet can be found in U.S. Pat. No. 5,435,884, which is incorporated herein by reference. Other conventional etching techniques, which should be known to those skilled in the art, are of course also possible.

While a pressure swirl nozzle is shown and described for providing a hollow conical air atomized fuel spray, it should be appreciated that other nozzle designs could alternatively (or in addition) be used with the present invention to provide other spray geometries, such as plain jet, solid cone, flat spray, etc. Also, while identical round spray orifices 106 are shown in fuel swirler plate 57 (FIG 9A), it should be appreciated that the dimensions and geometries of the orifices may vary across the plate, to tailor the fuel spray volume to a particular application. This can be easily accomplished by the aforementioned etching process.

Referring again to FIG. 3, swirler structure 47 also includes at least one of the plates of assembly 27. Preferably, the swirler structure 47 includes a plurality of plates 110–112, comprising a first upstream swirler plate 110 located adjacent the front surface 112 of upper cooling plate 58; a second upper swirler plate 111 located adjacent the first plate 110; and a downstream swirler plate 112 located adjacent the second plate 111.

As shown in FIGS. 11A and 11B, the first and second upstream swirler plates 110, 111 are identical, and each has a front (downstream) surface 125, and a rear (upstream) surface 126. The rear surface 126 of the first upstream swirler plate 110 is located adjacent the front surface 112 of upper cooling plate 58, while the rear surface 126 of the second upstream swirler plate 111 is located adjacent the front surface 125 of the first upstream swirler plate 110. While less preferred, the first upstream swirler plate 110 may be spaced from the upper cooling plate 58 such as with one or more spacer plates.

Figure 12C:
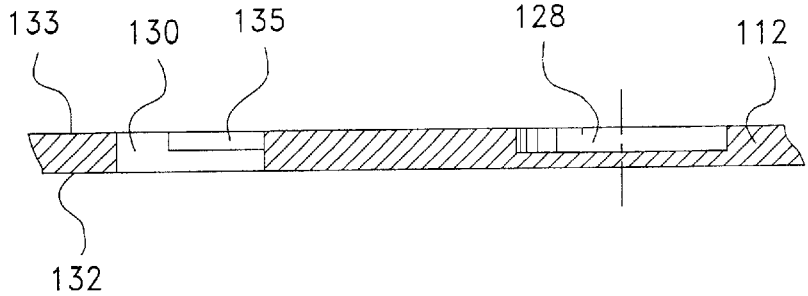
FIG. 12C is a cross-sectional side view of a portion of the third plate, taken substantially along the plane described by the lines 12C—12C of FIG. 12B.
Figure 12A:
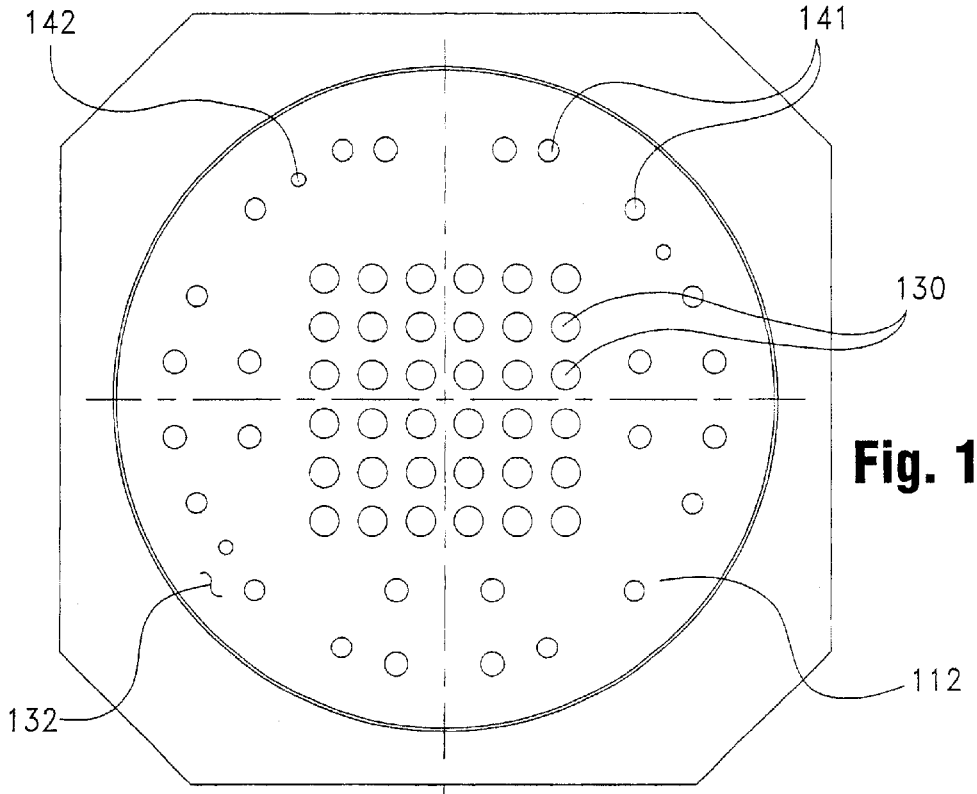
FIG. 12A is a front plan view of a third of the plates of the swirler structure.
Figure 12B:
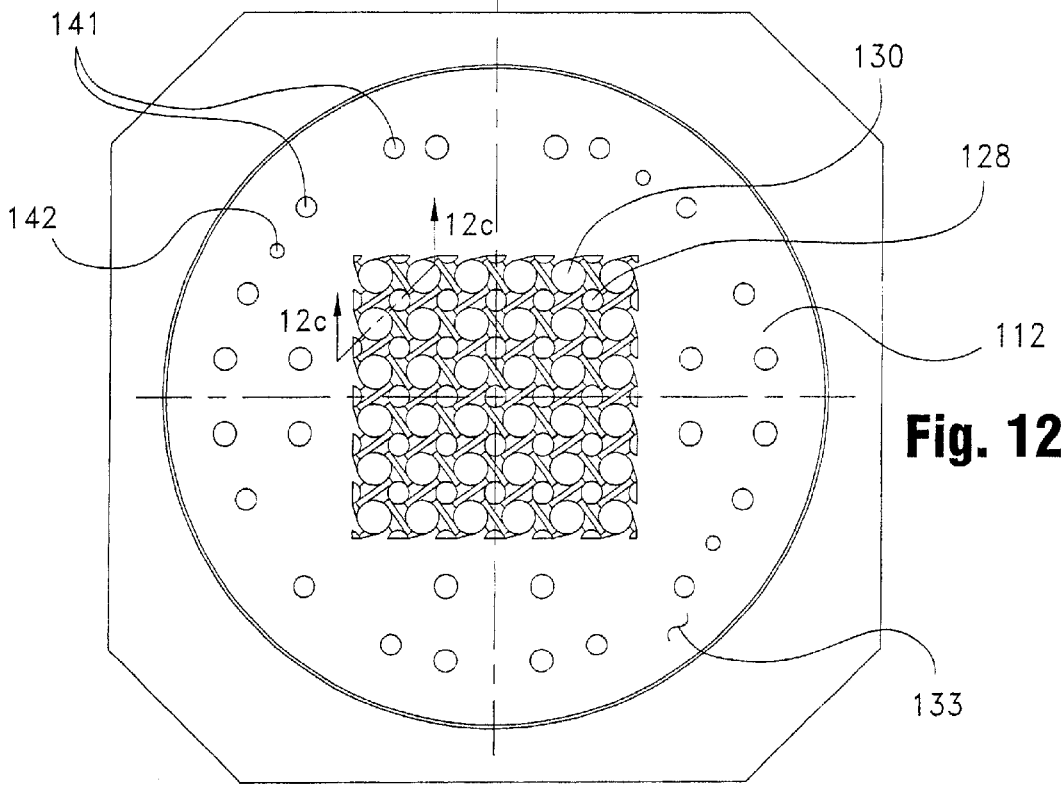
FIG. 12B is a rear plan view of the third plate.

In any case, passages 120 in upstream swirler plates 110, 111 are also arranged in an even, spaced-apart manner, in alignment with the respective passages in the adjacent swirler plate, and partial passages may be provided along the edges of the arrangement. Passages 120 in second upstream swirler plate 111 are axially and fluidly aligned with cylindrical passages 128 in adjacent downstream swirler plate 112 (FIG. 12A). Passages 123 in first and second upstream swirler plates 110, 111 are also arranged in an even, spaced-apart manner across the plate, and are fluidly aligned with one another and to cylindrical passages 130 on downstream swirler plate 112 (FIG. 12B). Cylindrical passages 123 and 130 have a diameter at least as great as the spray orifices 106 and preferably a diameter that is greater than the diameter of the spray orifices. Each plate 110, 111 further includes non-radial air feed channels 131 in rear surface 126 that fluidly interconnect passages 120 with passages 123. At least one, and preferably four non-radial channels 131 are provided. The channels preferably intersect passages 123 tangentially at about the midpoint of the channel, and can then extend to an adjacent passage 120. Channels 131 direct air from passages 120 in a swirling motion into cylindrical passages 123.

As shown in FIGS. 12A and 12B, the downstream swirler plate 112 has a front (downstream) surface 132, and a rear (upstream) surface 133 adjacent the front surface 125 of the second upstream swirler plate 111. Passages 128 in downstream swirler plate 112 are also arranged in an even, spaced-apart manner, and partial passages may be provided along the edges of the arrangement. As can be seen in FIG. 12C, passages 128 terminate in plate 112, that is, they do not extend entirely through this plate. Passages 130, conversely, extend through plate 112. Passages 130 in downstream swirler plate 112 are also arranged in an even, spaced-apart manner across the plate. Plate 112 includes non-radial air feed channels 135. At least one, and preferably four non-radial channels 135 interconnect passages 128 with passages 130. The channels preferably intersect passages 130 tangentially at about the midpoint of the channel, and can then extend to an adjacent passage 128. Channels 135, like channels 131 in plates 110, 111, direct air from passages 128 in a swirling motion into cylindrical passages 130.

The passages and channels in the plates of the swirler structure are also preferably formed by etching through a thin sheet of etchable material, e.g., metal. The etching of the plates of the swirler structure is also preferably a chemical or electrochemical etch, and further discussion can be found in U.S. Pat. No. 5,740,967. Again, other conventional etching techniques can be used.

Figure 13:
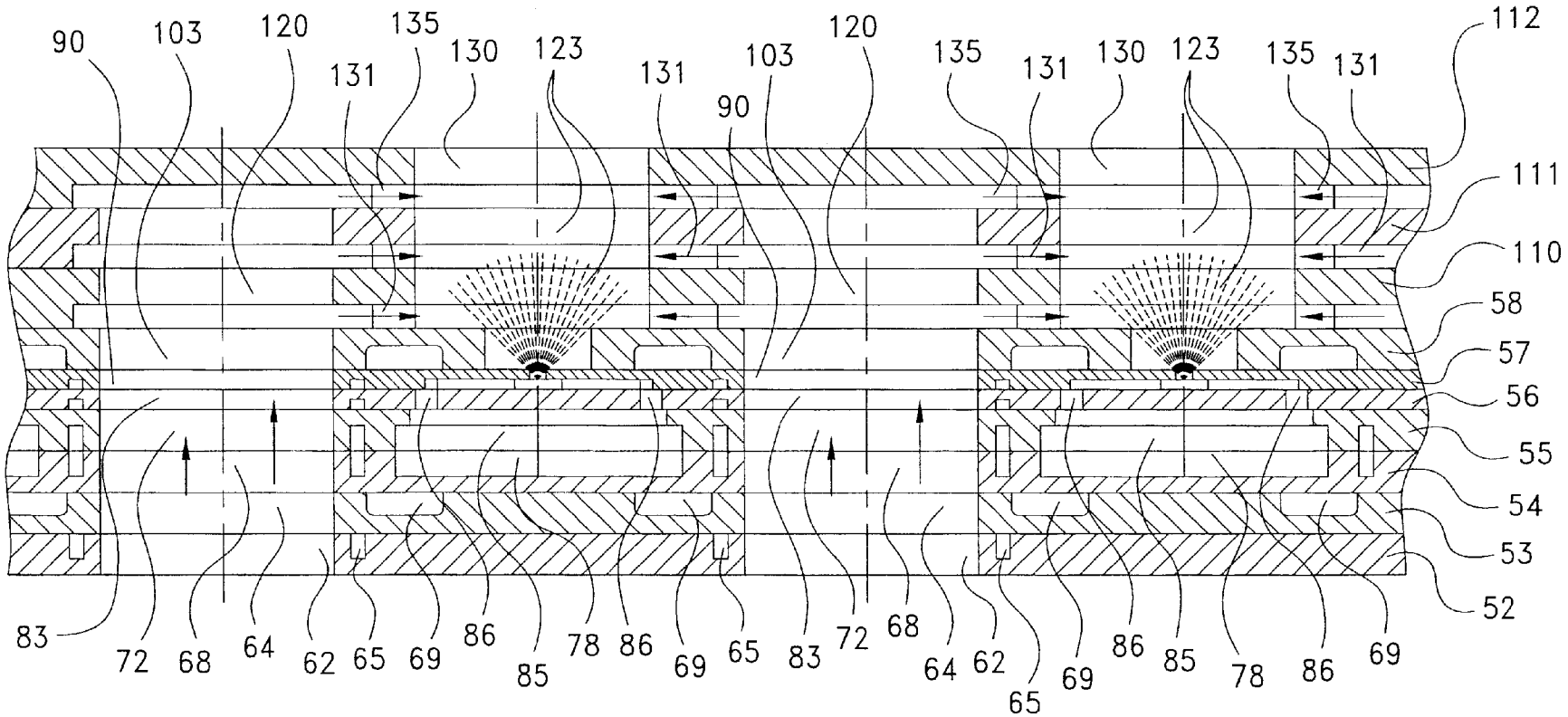
FIG. 13 is a cross-sectional side view of a portion of the plate assembly for the injector taken substantially along the plane described by lines 13—13 of FIG. 1.

As shown in FIG. 13, channels 131 in swirler plates 110, 111 and channels 135 in swirler plate 112 provide air in a swirling manner into cylindrical passages 123, 130. Fuel from orifices 106 in fuel swirler plate 57 (FIG. 9A) is likewise directed into passages 123, 130 upstream from the channels, and when the swirling air from the channels contacts the fuel spray, the air imparts a swirling component of motion to the fuel spray. The swirling fuel is then directed out through the passage 130 in downstream swirler plate 112, and is ignited downstream in the combustion chamber. It has been found that the swirling air enhances mixing and reduces NOX and CO emissions from the gas turbine engine, and reduces flame blowout. The metering set and integral swirler structure also provide good spray patternization and the spray is well-dispersed for efficient combustion. The swirler structure is also compact and light weight, and can be accurately and repeatably manufactured.

While three layers of air feed channels are shown, it should be appreciated that the number of layers affects the amount of swirling air directed into the fuel spray, and can be increased or decreased depending upon the particular application. In fact, in some applications it may only be necessary to have a single layer of air feed channels (or only one feed channels in each layer(s)) supplying air in a swirling manner into the fuel spray. The air feed channels can even be incorporated into one (or more) of the plates of the fuel metering set, to provide an even more compact injector. The number of layers and number of feed channels can be easily determined by one of ordinary skill in the art depending upon the particular application. It is also noted that the swirl passages 123 and 130 preferably all have the same diameter and dimension, although they could also have varying diameters and dimensions (for example to form a diverging or converging opening) depending upon the particular application. Still further, while a swirling air stream in surrounding relation to the fuel spray is preferred, it is also possible that the air could be introduced in a non-swirling manner, such as radially inward, or axially upward into the flow of fuel. These geometries are less preferred, but may be appropriate in certain applications.

Plates 110–112 of swirler structure 47 can be interconnected together such as by high temperature brazing. The plates 52–58 of the fuel metering set, and plates 110–112 of the swirler structure are fixed to body 21, such as by fasteners (e.g., bolts) 140 (FIGS. 1, 2) extending through holes 141 (FIGS. 4A–12B) around the periphery of each of the plates. The fasteners allow the plates to be easily assembled with the body 21 and removed for inspection and repair. Each plate can be formed individually using the aforementioned etching process, although as shown in FIGS. 5A, 5B, a plurality of plates can be formed together for further accuracy and efficiency, and then later separated if necessary or desirable.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An injector assembly for dispensing fuel for ignition in a combustion chamber, said injector assembly comprising:

a plurality of flat plates of etchable material, and a plurality of injectors formed in said plates, each of said injectors including:

a fuel metering set including a bowl-shaped fuel swirl chamber shaped by etching formed in a first side of one of said plates, such that fuel to be sprayed from the injector can move therein in a vortex motion toward the center of the fuel swirl chamber; a spray orifice in fluid communication with the center of the fuel swirl chamber and extending substantially co-axial therewith to a second side of said plate such that fuel to be sprayed from the injector can move from the fuel swirl chamber to the spray orifice and then exit the spray orifice through the second side in a spray for ignition in the combustion chamber; at least one fuel feed slot in fluid communication with the fuel swirl chamber and extending in non-radial relation thereto for supplying fuel to be sprayed through the injector; and an air swirler assembly including a cylindrical air swirler passage shaped by etching through at least one other of the plates, a plate of the air swirler assembly in adjacent relation to the second side of the plate of the fuel metering set, the cylindrical air swirler passage located in co-axial relation to the spray orifice of the plate of the fuel metering set such that fuel directed through the spray orifice passes through the air swirler passage and swirling air can be imparted to the fuel to cause the fuel to have a swirling component of motion before ignition; at least one air feed slot extending in the plane of one of the plates of the air swirler assembly in fluid communication with the air swirler passage and extending in non-radial relation thereto for supplying air to be swirled in the air swirler passage; and an air supply passage which feeds the at least one air feed slot, the air supply passage extending through at least a portion of a plate of the air swirler assembly to a downstream end wherein a plate of the air swirler assembly encloses the downstream end of the air supply passage and separates the air supply passage from the combustion chamber.

2. The injector assembly as in claim 1, wherein the air swirler assembly includes multiple plates in surface-to-surface adjacent relation, each of said plates of the air swirler assembly having a portion of the cylindrical air swirler passage with the portions arranged in co-axial relation with one another, each of the plates of the air swirler assembly including a plurality of air feed slots spaced around the air swirler chamber in fluid communication with the respective air swirler portion and extending in non-radial relation thereto for supplying multiple air streams to be swirled in the air swirler passage.

3. The injector assembly as in claim 2, wherein the air supply passage feeds an air feed slot in each plate of all the multiple plates of the air swirler assembly.

4. The injector assembly as in claim 3, wherein the air supply passage feeds air feed slots of adjacent air swirler passages in each plate of the air swirler assembly.

5. The injector assembly as in claim 4, wherein the air supply passage extends axially through the multiple plates of the air swirler assembly.

6. The injector assembly as in claim 1, wherein the plates are arranged in surface-to-surface relation with one another.

7. An atomizing injector, comprising:

a metering set including a plate of etchable material, a first feed slot for supplying fuel to the plate and an orifice in the plate for dispensing the fuel; and air swirler structure integral with the metering set and including multiple plates of etchable material, a mixing passage shaped by etching through the plates of the swirler structure, the mixing passage located in relation to the orifice of the plate of the metering set such that the fuel directed through the orifice passes through the mixing passage and air can be mixed with the fuel; at least one second feed slot in fluid communication with the mixing passage for supplying the air to be mixed in the mixing passage; and an air supply passage which feeds the at least one second feed slot, the air supply passage extending axially through at least some of the plates of the swirler structure to a downstream end, with one of the plates of the swirler structure enclosing the downstream end of the air supply passage.

8. The atomizing injector as in claim 7, wherein the air supply passage feeds all the at least one second feed slots of the multiple plates of the swirler structure.

9. The atomizing injector as in claim 7, wherein the plate of the metering set and the plates of the swirler structure are formed of metal.

10. The atomizing injector as in claim 7, wherein the at least one second feed slot is shaped by etching one of the plates of the air swirler structure.

11. The atomizing injector as in claim 7, wherein the at least one second feed slot extends in the plane of one of the plates of the swirler structure.

12. The atomizing injector as in claim 7, wherein the plates are arranged in surface-to-surface relation with one another.

* * * * *